US009807496B1

(12) United States Patent
Hecht

(10) Patent No.: US 9,807,496 B1
(45) Date of Patent: Oct. 31, 2017

(54) IN-WALL OR IN-CEILING SPEAKER ENCLOSURE AND ASSOCIATED METHOD

(71) Applicant: MS Electronics LLC, Overland Park, KS (US)

(72) Inventor: Kenneth Hecht, Jacksonville, FL (US)

( * ) Notice: Subject to any disclaimer, the term of this patent is extended or adjusted under 35 U.S.C. 154(b) by 0 days.

(21) Appl. No.: 15/265,773

(22) Filed: Sep. 14, 2016

(51) Int. Cl.
*H04R 1/28* (2006.01)
*G10K 11/16* (2006.01)
*H04R 1/02* (2006.01)

(52) U.S. Cl.
CPC ..... *H04R 1/2819* (2013.01); *G10K 11/16* (2013.01); *H04R 1/026* (2013.01); *H04R 2201/021* (2013.01)

(58) Field of Classification Search
CPC ..... H04R 2201/021; H04R 1/2819
USPC ..... 181/150, 152, 199; 381/349
See application file for complete search history.

(56) References Cited

U.S. PATENT DOCUMENTS 2,744,584 A * 5/1956 Hellon ..... H04R 1/021 181/150
3,938,617 A * 2/1976 Forbes ..... H04R 1/025 181/148
2010/0181141 A1* 7/2010 Olds ..... F16M 11/22 181/199
2011/0280432 A1* 11/2011 Tracy ..... B60R 11/0217 381/395
2014/0357177 A1* 12/2014 Stewart, Jr. ..... E04B 9/003 454/258

* cited by examiner

*Primary Examiner* — Jeremy Luks

(57) ABSTRACT

An in-wall or in-ceiling speaker enclosure includes a speaker back box having one or more apertures covered with an air-filtering member (e.g., open cell foam, baffling material, etc.) that may be utilized with speakers mounted on a large baffle (wall or ceiling) for reducing sound transmission to an adjacent room while significantly lowering the resonance of the speaker system and allowing the speakers to produce much greater bass energy into a desired room. Such a speaker back box includes a posterior surface, a plurality of sidewalls engaged with the posterior surface and extending anterior thereof wherein one of the sidewalls includes a first aperture. The speaker back box further includes an anterior opening oppositely disposed from the posterior surface. A flexible and resilient air-filtering member is positioned against the first aperture wherein the air-filtering member is intermediately located between the posterior surface and anterior opening.

19 Claims, 12 Drawing Sheets

IN-WALL OR IN-CEILING SPEAKER ENCLOSURE AND ASSOCIATED METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to speaker enclosures and, more particularly, to an in-wall or in-ceiling speaker enclosure including a back box having one or more apertures covered with an air-filtering, acoustically absorptive member (e.g., open cell foam or other acoustically absorptive material with similar characteristics, etc.) that may be utilized with speakers mounted on a large baffle (wall or ceiling) for reducing sound transmission to an adjacent room while significantly lowering the resonance of the speaker system and allowing the speakers to produce much greater bass energy into a desired room.

Prior Art

The majority of in-wall and in-ceiling speakers are designed to bring sound into a room without being visibly intrusive. These speakers often have an enclosure to improve quality. Some examples of in-wall and in-ceiling speaker enclosures include the following: acoustic suspension, bass reflex, and infinite baffle.

The acoustic suspension speaker enclosure uses a sealed (air tight) rear enclosure to keep a rear wave of the speaker from cancelling a front wave of the speaker.

The bass reflex speaker enclosure is also airtight, like the acoustic suspension, except for a small open vent or port at the front. The principal behind this is that the rear wave is delayed so the sound that emerges through the port is changed 180 degrees from the rear wave at certain (lower) frequencies putting it in phase with the front wave. The rear waves coming out of the port reinforce the front waves coming directly from the speaker, thereby increasing the overall bass output.

The infinite baffle speaker enclosure type of enclosure assumes a very large (infinite) baffle surface with a very large (infinite) volume behind it. With this type of enclosure there is no resistance to speaker motion due to trapped air in the enclosure. The resonance of the speaker is very close to its natural resonance producing more bass output then the other designs.

In-wall and in-ceiling speakers on the market today typically use one of the aforementioned speaker enclosures. All such speaker enclosures are mounted on a large baffle (wall or ceiling) with the front wave isolated from the rear wave. In all cases, the speaker drivers are mounted very close to the surface of the wall or ceiling creating sound into a room. One problem in a home is that a low frequency driver or woofer produces an equal amount of energy behind the wall or ceiling as into the room. This can be bothersome if the wall or ceiling to which the speaker is mounted is shared with another interior room.

To lower the transmission of sound into the adjacent room, some installers use wall board materials with high sound transmission class (STC) ratings. This can be very costly, so in-wall and in-ceiling manufacturers started including back boxes with their speakers to limit the amount of sound transmitted into the adjacent room. This lowers the sound transmission to the adjacent room but changes the enclosure design to an acoustic suspension or bass reflex. It is also generally believed that the bass sounds from a speaker mounted in a wall or ceiling with no back box tend to sound less controlled or the bass sounds less defined then a woofer mounted in a bass reflex of acoustic suspension enclosure.

Because of the limited amount of depth in a typical 2-inch×4-inch stud wall and the limited size of the opening that allows a back box to go into the space-confined wall or space-confined ceiling, the rear side on these speaker enclosures is inherently small. The peripheral sides of the back box have to be smaller in height and width then the corresponding height and width of the baffle to allow the speaker enclosure to pass through the opening in the wall and ceiling, and the speaker baffle seal against the wall. The small size of the speaker enclosure raises the system resonance thereby raising the lowest frequencies the speaker can efficiently output sound waves.

Accordingly, a need remains for an in-wall and in-ceiling speaker enclosure in order to overcome at least one aforementioned shortcoming. The exemplary embodiment(s) satisfy such a need by providing an in-wall or in-ceiling speaker enclosure including a back box having one or more apertures covered with an air-filtering member (e.g., open cell foam, baffling material, etc.), which may be utilized with speakers mounted on a large baffle (wall or ceiling) that is convenient and easy to use, lightweight yet durable in design, versatile in its applications, and designed for reducing sound transmission to an adjacent room while significantly lowering the resonance of the speaker system, allowing the speakers to produce much greater bass energy into a desired room and having the added benefit of more controlled and better sounding bass.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide an in-wall or in-ceiling speaker enclosure for reducing undesirable sound transmission to an adjacent room while decreasing resonance and increasing bass output into a desired room. These and other objects, features, and advantages of the non-limiting exemplary embodiment(s) are provided by the in-wall or in-ceiling speaker enclosure including a speaker back box having a single and unitary body suitably sized and capable of being mounted inside one of a vertical wall cavity and a ceiling wall cavity. Such a speaker back box includes a posterior surface, a plurality of sidewalls engaged with the posterior surface and extending anterior thereof wherein one of the sidewalls includes a first aperture. The speaker back box further includes an anterior opening oppositely disposed from the posterior surface. A flexible and resilient air-filtering member is positioned against the first aperture wherein the air-filtering member is intermediately located between the posterior surface and anterior opening.

It is noted that the back box may be cylindrical, square, oval, trapezoidal, etc. Additionally, the quantity of apertures may vary as needed. Also, the air-filtering member may be positioned at an interior or exterior of the back box so long as it covers the apertures. In this manner, neither the shape of the back box nor the quantity of apertures nor the location of the air-filtering member is a limiting factor to the true spirit and scope of the present disclosure.

In a non-limiting exemplary embodiment, the sidewalls include a first sidewall, a second sidewall, a third sidewall and a fourth sidewall configured with the posterior surface to form a generally rectangular shape. In this manner, the first sidewall is registered substantially parallel to the second sidewall, and the third sidewall and the fourth sidewall are registered substantially orthogonal to each of the first sidewall and the second sidewall.

In a non-limiting exemplary embodiment, the first aperture is disposed at the first sidewall and spaced from the posterior surface.

In a non-limiting exemplary embodiment, a second aperture disposed at the second sidewall and spaced from the posterior surface.

In a non-limiting exemplary embodiment, the first aperture is oppositely disposed from the second aperture.

In a non-limiting exemplary embodiment, the air-filtering member includes a first acoustic insulation layer positioned anterior of the posterior surface and abutted against an interior face of the first sidewall such that an entire surface area of the first aperture is covered.

In a non-limiting exemplary embodiment, the air-filtering member further includes a second acoustic insulation layer positioned anterior of the posterior surface and abutted against an interior face of the second sidewall such that an entire surface area of the second aperture is covered.

In a non-limiting exemplary embodiment, the first acoustic insulation layer is oppositely disposed from the second acoustic insulation layer. Notably, the first aperture is registered along a first plane registered substantially orthogonal to the posterior surface. Similarly, the second aperture is registered along a second plane registered substantially orthogonal to the posterior surface.

In a non-limiting exemplary embodiment, each of the first acoustic insulation layer and the second acoustic insulation layer includes an open cell foam containing an air-permeable cellular fiber material.

The present disclosure further includes a method of utilizing an in-wall or in-ceiling speaker enclosure for reducing undesirable sound transmission to an adjacent room while decreasing resonance and increasing bass output into a desired room. Such a method includes the initial step of: providing a speaker back box having a single and unitary body suitably sized and capable of being mounted inside one of a vertical wall cavity and a ceiling wall cavity. The speaker back box includes a posterior surface, a plurality of sidewalls engaged with the posterior surface and extending anterior thereof wherein one of the sidewalls includes a first aperture, and an anterior opening is oppositely disposed from the posterior surface.

The method further includes the steps of: providing a flexible and resilient air-filtering member; and positioning the flexible and resilient air-filtering member against the first aperture such that the air-filtering member is intermediately located between the posterior surface and anterior opening.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
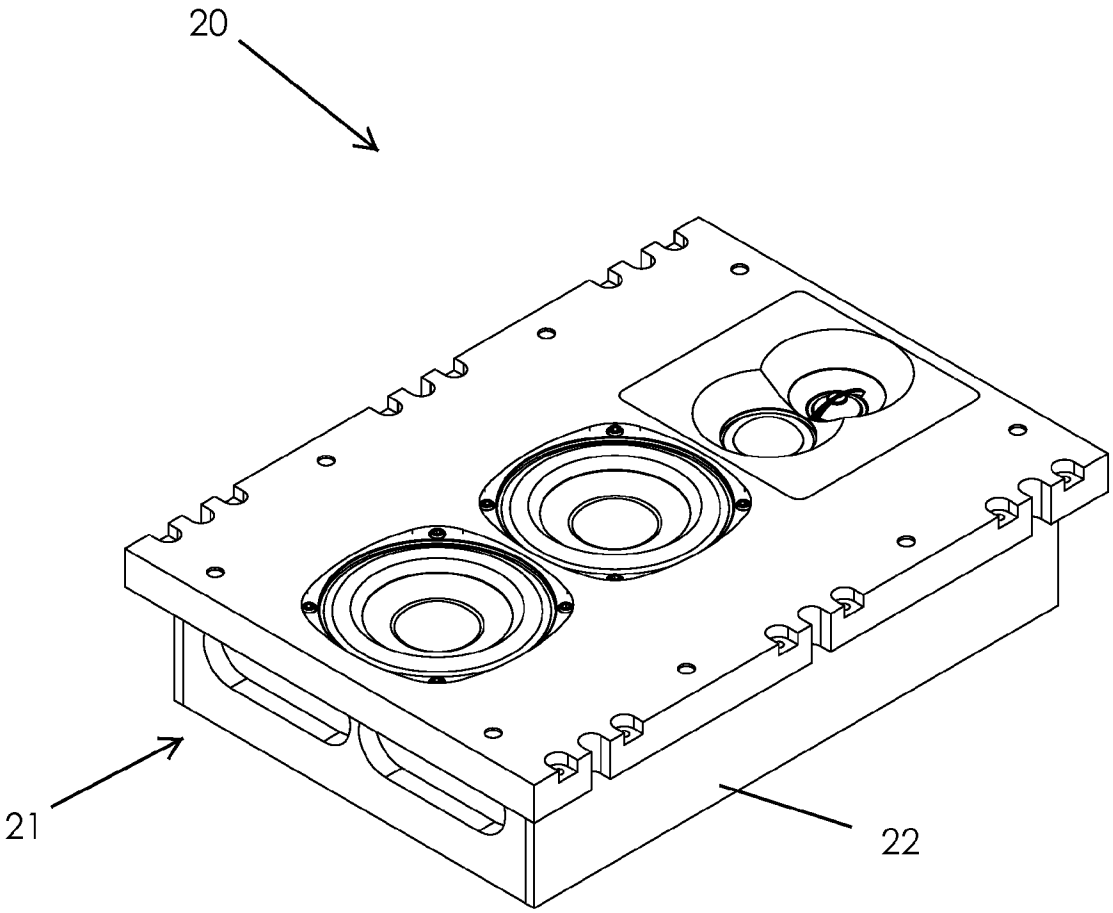
FIG. 1 is a perspective view of an in-wall or in-ceiling speaker enclosure including a back box for reducing sound transmission to an adjacent room while significantly lowering the resonance of the speaker system and allowing the speakers to produce much greater bass energy into a desired room, in accordance with a non-limiting exemplary embodiment of the present disclosure.
Figure 2:
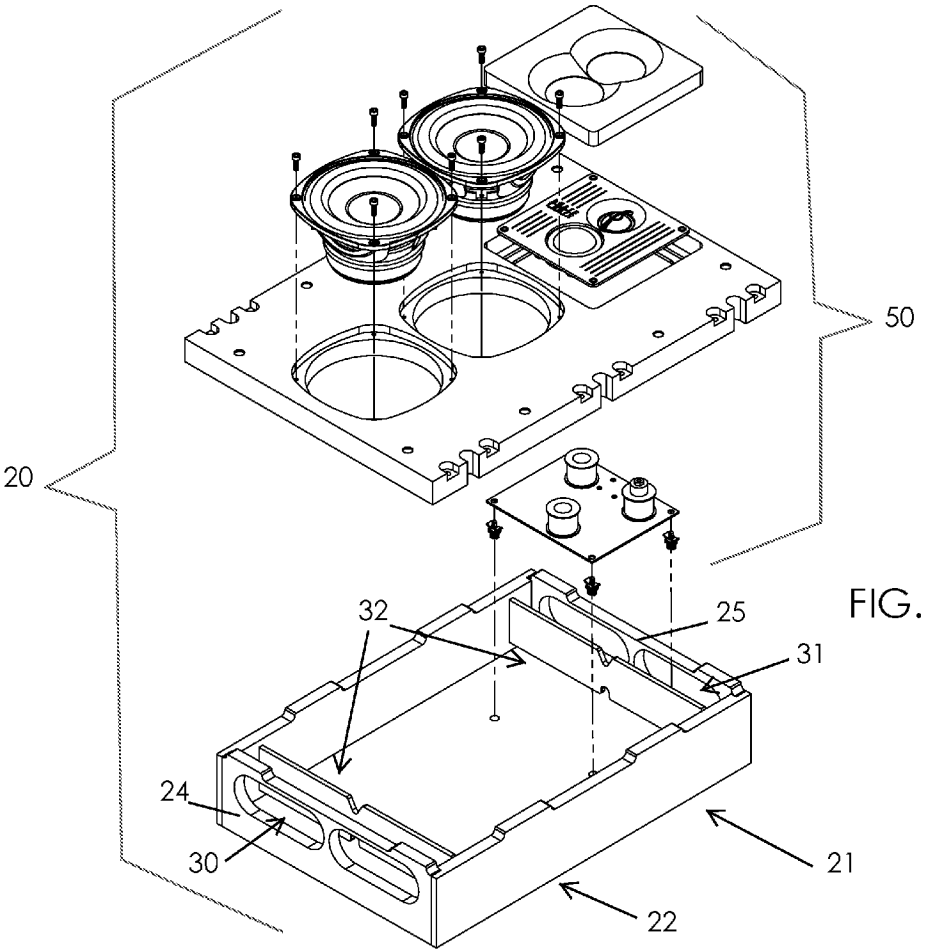
FIG. 2 is an exploded view of the in-wall or in-ceiling speaker enclosure illustrated in FIG. 1.
Figure 3:
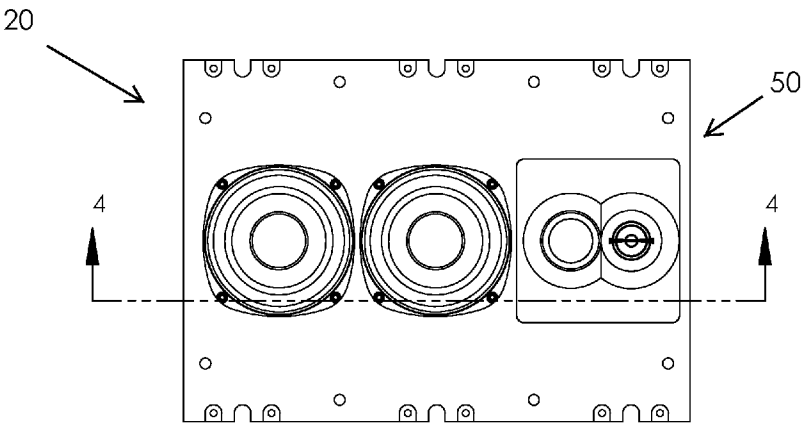
FIG. 3 is a top plan view of the in-wall or in-ceiling speaker enclosure illustrated in FIG. 2.
Figure 4:
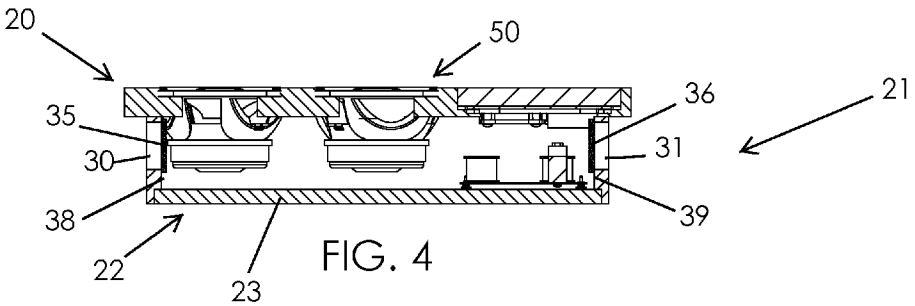
FIG. 4 is cross-sectional view taken along line 4-4 in FIG. 3.
Figure 5:
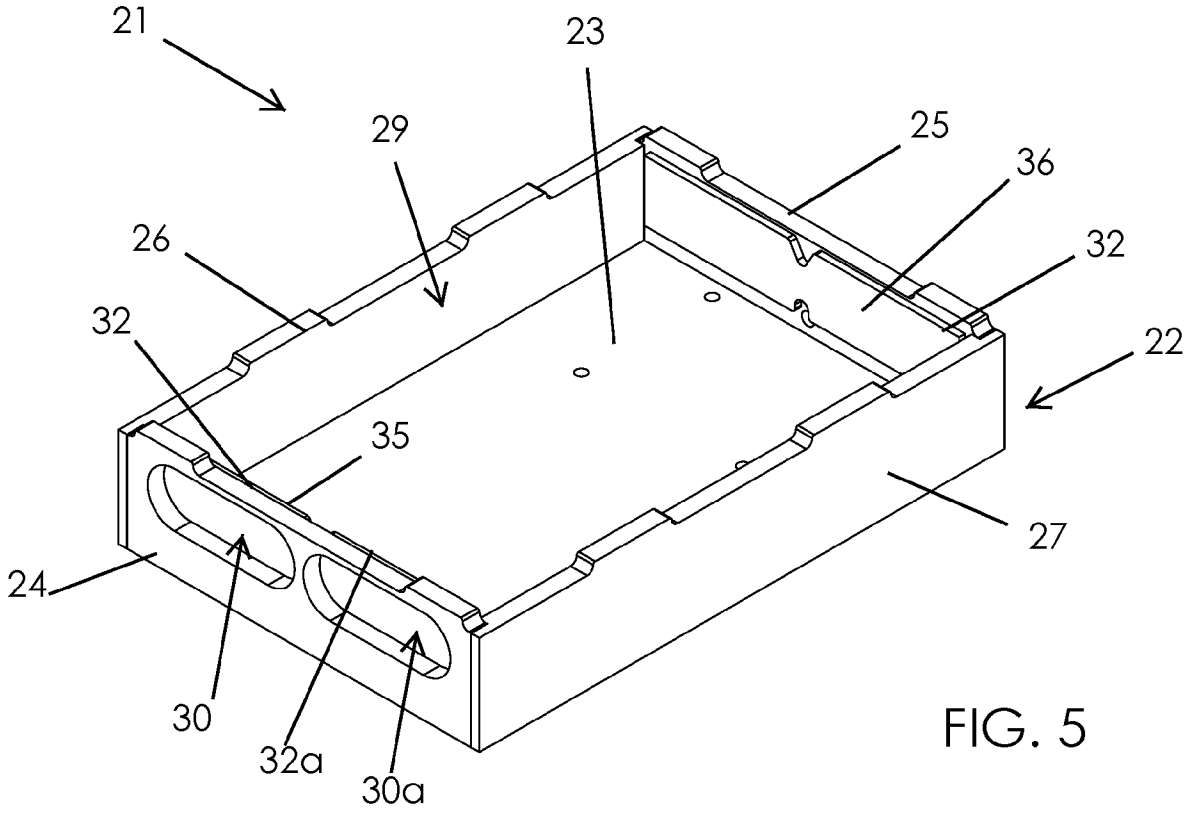
FIG. 5 is a perspective view of an in-wall or in-ceiling speaker back box.
Figure 6:
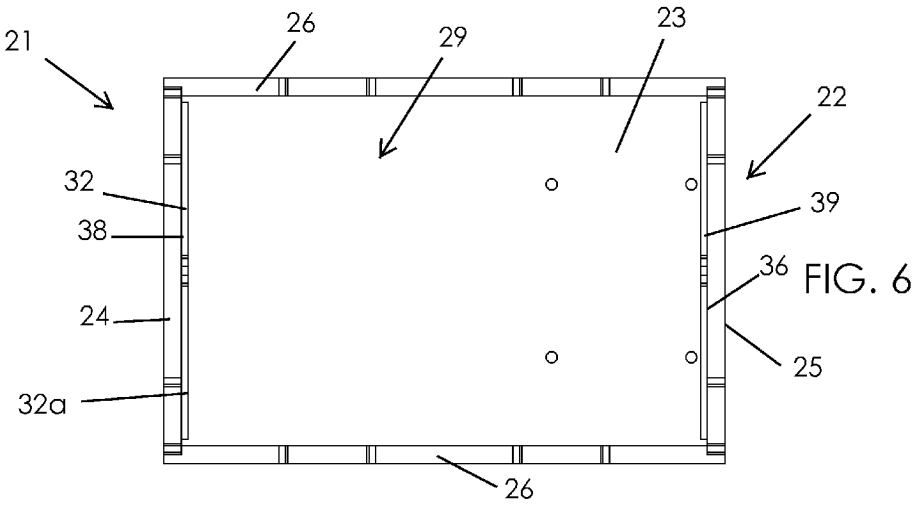
FIG. 6 is a top plan view of the in-wall or in-ceiling speaker back box illustrated in FIG. 5.
Figure 7:
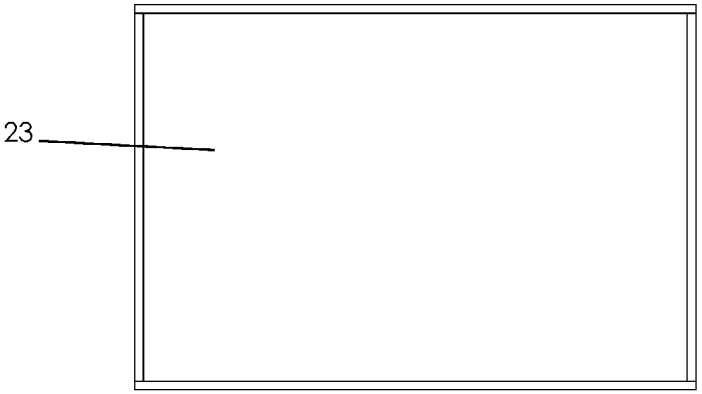
FIG. 7 is a bottom plan view of the in-wall or in-ceiling speaker back box illustrated in FIG. 5.
Figure 8:
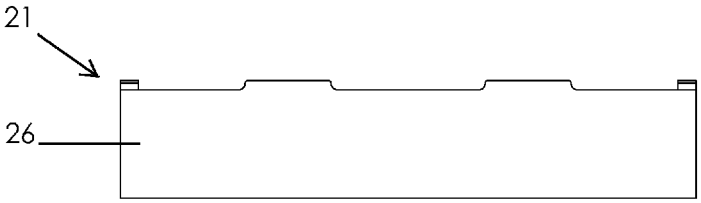
FIG. 8 is a left side elevational view of the in-wall or in-ceiling speaker back box illustrated in FIG. 5.
Figure 9:
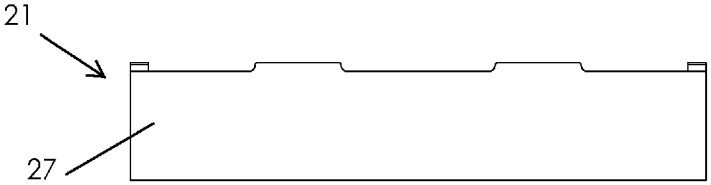
FIG. 9 is a right side elevational view of the in-wall or in-ceiling speaker back box illustrated in FIG. 5.
Figure 10:
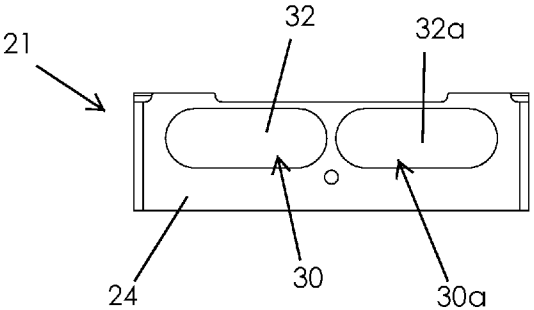
FIG. 10 is a front elevational view of the in-wall or in-ceiling speaker back box illustrated in FIG. 5.
Figure 11:
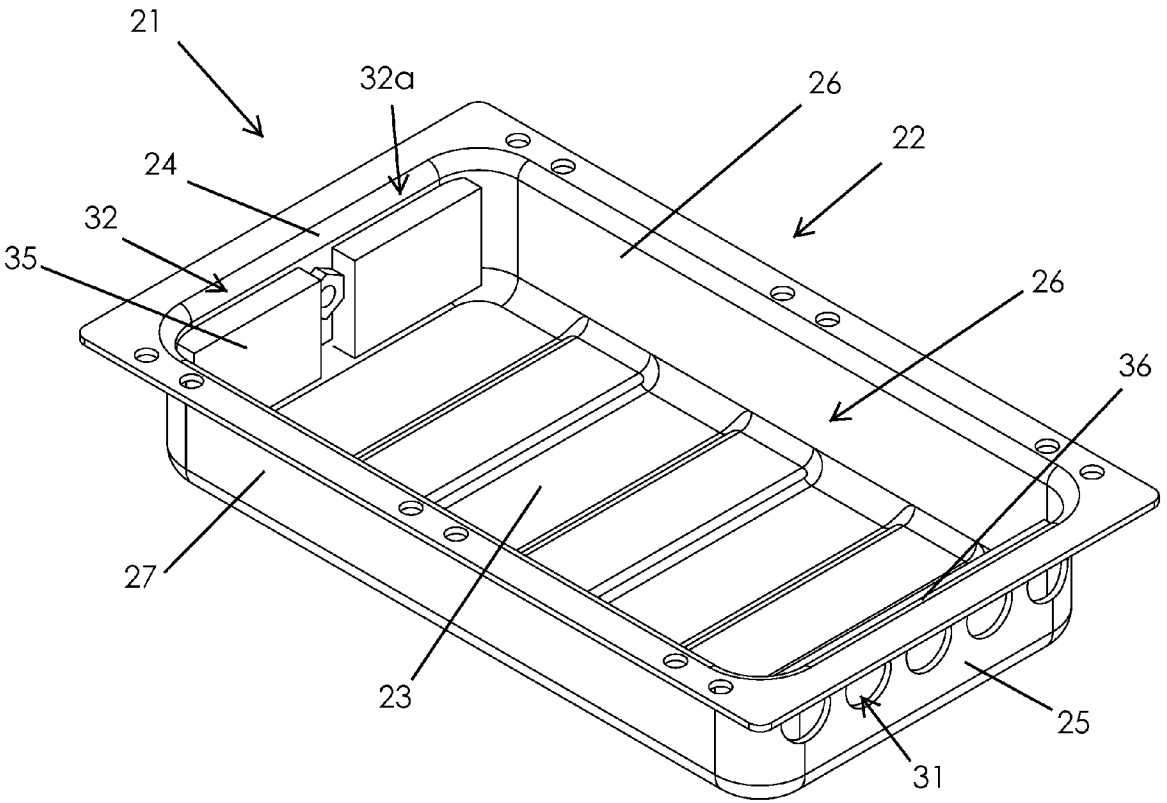
FIG. 11 is a perspective view of an in-wall or in-ceiling speaker back box, in accordance with another non-limiting exemplary embodiment of the present disclosure.
Figure 12:
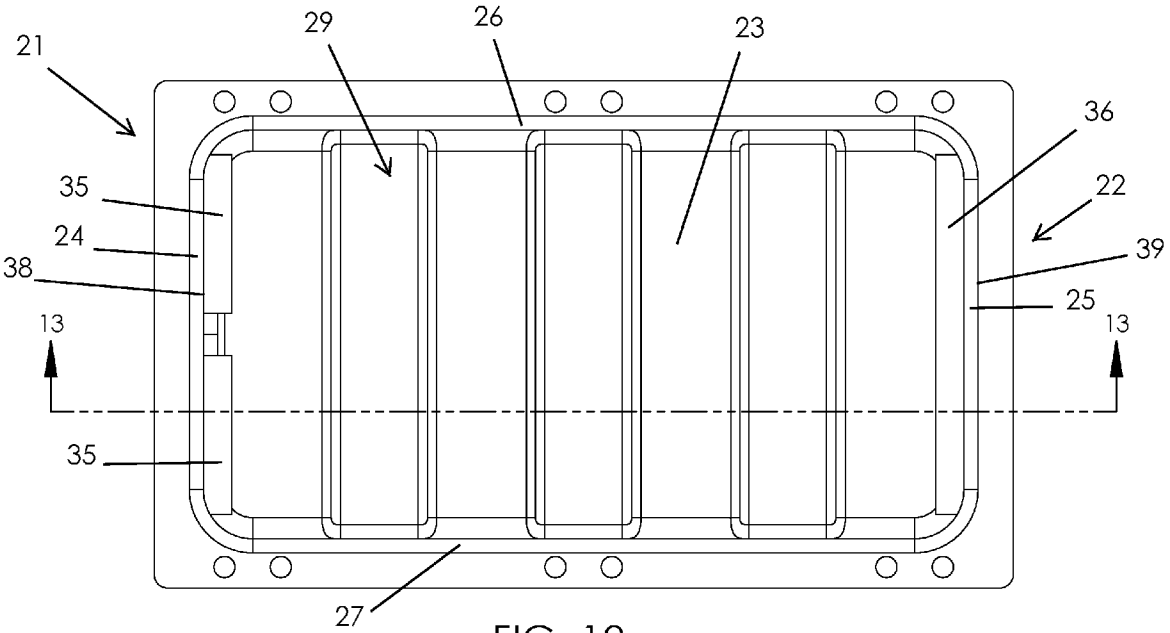
FIG. 12 is a top plan view of the in-wall or in-ceiling speaker back box illustrated in FIG. 11.
Figure 13:
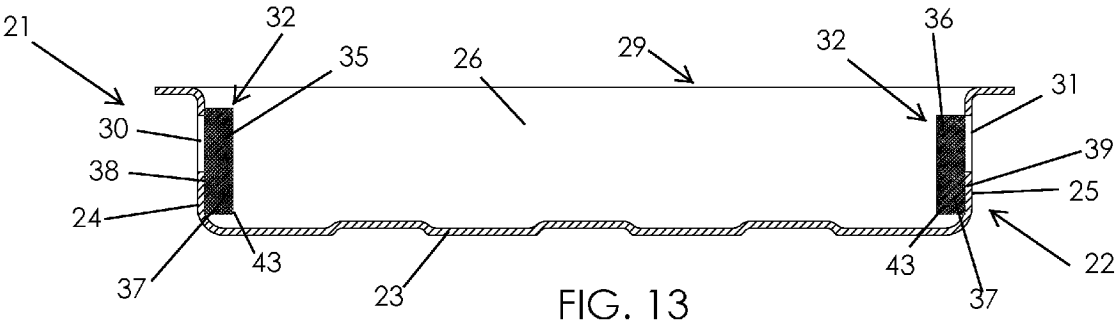
FIG. 13 is cross-sectional view taken along line 13-13 in FIG. 12.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

The non-limiting exemplary embodiment(s) is/are referred to generally in FIGS. 1-17 and is/are intended to provide an in-wall or in-ceiling speaker enclosure 20 employed with a speaker back box 21 that lowers the transmission of sound waves into an adjacent room while keeping the bass output at levels close to an infinite baffle design. In particular, the speaker back box 21 lowers the transmission of sound waves into an adjacent room while keeping the bass output at levels close to an infinite baffle design. The back box 21 includes apertures 30, 31 that allow air flow to travel into the large space behind a wall or ceiling. Open cell foam 32 or other suitable batting material is placed over the apertures 30, 31. Such a structural configuration allows air to flow with very little resistance but because of the random nature of the fiber and cell structure of the open cell foam 32 or batting material, it significantly lowers the amount of sound that can pass through. Such a structural configuration provides advantages of a solid-wall back box 21 while significantly lowering the resonance of the speaker system 20, thereby allowing it to produce much greater bass energy into the room.

It is noted that the back box may be cylindrical, square, oval, trapezoidal, etc. Additionally, the quantity of apertures may vary as needed. Also, the air-filtering member may be positioned at an interior or exterior of the back box so long as it covers the apertures. In this manner, neither the shape of the back box nor the quantity of apertures nor the location of the air-filtering member is a limiting factor to the true spirit and scope of the present disclosure. In-ceiling speaker enclosures 20 typically have cylindrical back boxes. In this version, the apertures may be spaced around the cylindrical wall.

The present disclosure includes speaker back box 21 including at least one aperture 30, 31 to allow air flow to travel into the large space behind the wall or ceiling. An air-filtering member 32 (e.g., open cell foam 37 or other suitable batting material) is placed over the apertures 30, 31. For example, the air-filtering members 32 may include acoustically absorptive material (e.g., wool pads). Such a structural configuration allows air to flow with very little resistance but because of the random nature of the fiber and cell structure of the air-filtering member 32 (e.g., open cell foam 37 or other suitable batting material), it significantly lowers the amount of sound that can pass through.

Still referring to FIGS. 1-19 in general, alternate embodiments of the in-wall or in-ceiling speaker enclosure 20, are illustrated, for reducing undesirable sound transmission to an adjacent room while decreasing resonance and increasing bass output into a desired room. Such an in-wall or in-ceiling speaker enclosure 20 includes a speaker back box 21 having a single and unitary body 22 suitably sized and capable of being mounted inside one of a vertical wall cavity (not shown) and a ceiling wall cavity (not shown).

In a non-limiting exemplary embodiment, the speaker enclosure 20 may be approximately 23.5-inches H×14-inches W×3.875-inches D. The size of the enclosure is dependent on the woofer size. It could be much smaller or much larger.

The speaker back box 21 includes a posterior surface 23, a plurality of sidewalls 24-27 engaged with the posterior surface 23 and extending anterior thereof wherein one of the sidewalls 24 includes at least a first aperture 30. The speaker back box 21 further includes an anterior opening 29 oppositely disposed from the posterior surface 23. A flexible and resilient air-filtering member 32 is positioned against the first aperture 30 wherein the air-filtering member 32 is intermediately located between the posterior surface 23 and anterior opening 29.

In a non-limiting exemplary embodiment, additional aperture 30*a* and air-filtering member 32*a* may be employed without departing from the true spirit and scope of the present disclosure. It is noted that several apertures 30 may be arranged in a variety of patterns or one aperture 30 may be provided. The number, size, shape, and orientation of the apertures 30 and air-filtering members 32 are not intended to be limiting to the true spirit and scope of the present disclosure.

In a non-limiting exemplary embodiment, the sidewalls 24-27 include a first sidewall 24, a second sidewall 25, a third sidewall 26 and a fourth sidewall 27 configured with the posterior surface 23 to form a generally rectangular shape. In this manner, the first sidewall 24 is registered substantially parallel to the second sidewall 25, and the third sidewall 26 and the fourth sidewall 27 are registered substantially orthogonal to each of the first sidewall 24 and the second sidewall 25.

In a non-limiting exemplary embodiment, the first aperture 30 is disposed at the first sidewall 24 and spaced from the posterior surface 23.

In a non-limiting exemplary embodiment, a second aperture 31 is disposed at the second sidewall 25 and spaced from the posterior surface 23.

In a non-limiting exemplary embodiment, additional aperture 31*a* may be employed without departing from the true spirit and scope of the present disclosure. It is noted that several apertures 31 may be arranged in a variety of patterns or one aperture 31 may be provided. The number, size, shape, and orientation of the apertures 31 and air-filtering members 32 are not intended to be limiting to the true spirit and scope of the present disclosure.

In a non-limiting exemplary embodiment, the first aperture 30 is oppositely disposed from the second aperture 31.

In a non-limiting exemplary embodiment, the air-filtering member 32 includes a first acoustic insulation layer 35 positioned anterior of the posterior surface 23 and abutted against an interior face 38 of the first sidewall 24 such that an entire surface area of the first aperture 30 is covered.

In a non-limiting exemplary embodiment, the air-filtering member 32 further includes a second acoustic insulation layer 36 positioned anterior of the posterior surface 23 and abutted against an interior face 39 of the second sidewall 25 such that an entire surface area of the second aperture 31 is covered.

In a non-limiting exemplary embodiment, the first acoustic insulation layer 35 is oppositely disposed from the second acoustic insulation layer 36. Notably, the first aperture 30 is registered along a first plane 40 registered substantially orthogonal to the posterior surface 23. Similarly, the second aperture 31 is registered along a second plane 41 registered substantially orthogonal to the posterior surface 23.

In a non-limiting exemplary embodiment, each of the first acoustic insulation layer 35 and the second acoustic insulation layer 36 includes an open cell foam 37 containing an air-permeable cellular fiber material 43.

Figure 14:
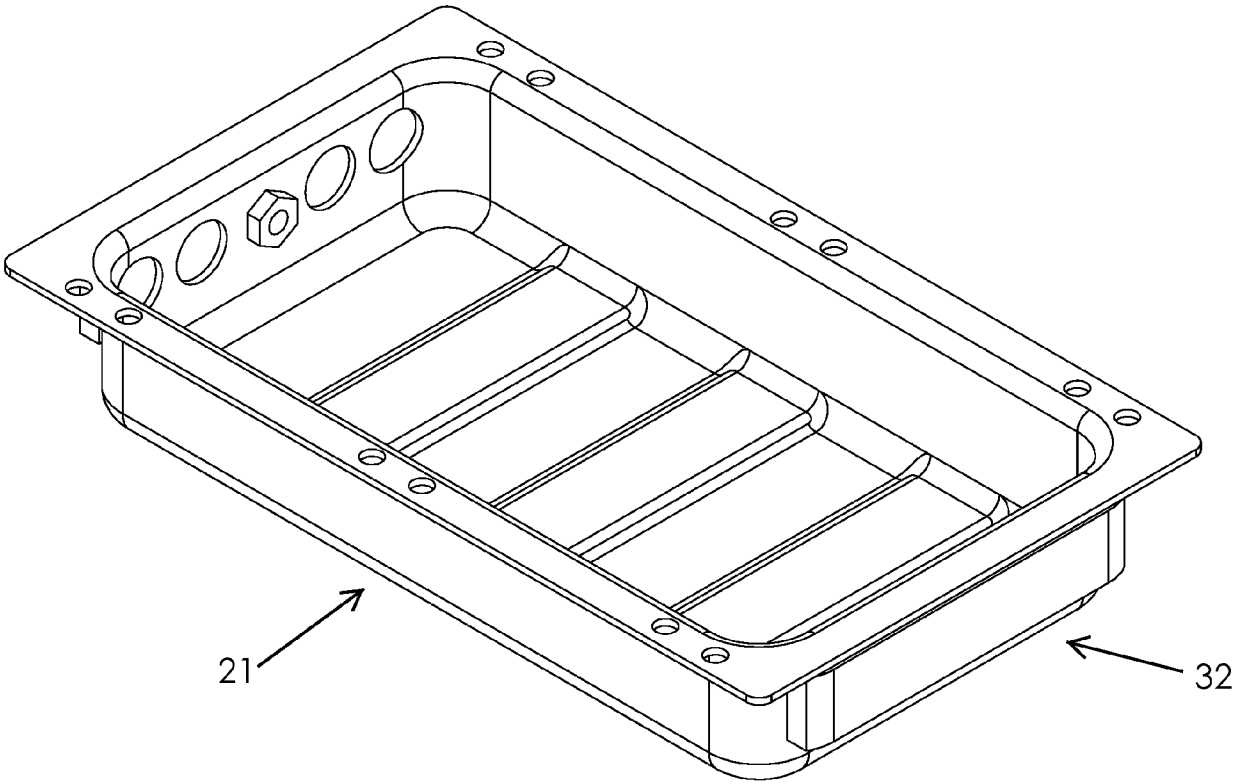
FIG. 14 is a perspective view of the in-wall or in-ceiling speaker back box wherein the air-filtering members are located exterior of thereof, in accordance with an alternate embodiment.
Figure 15:
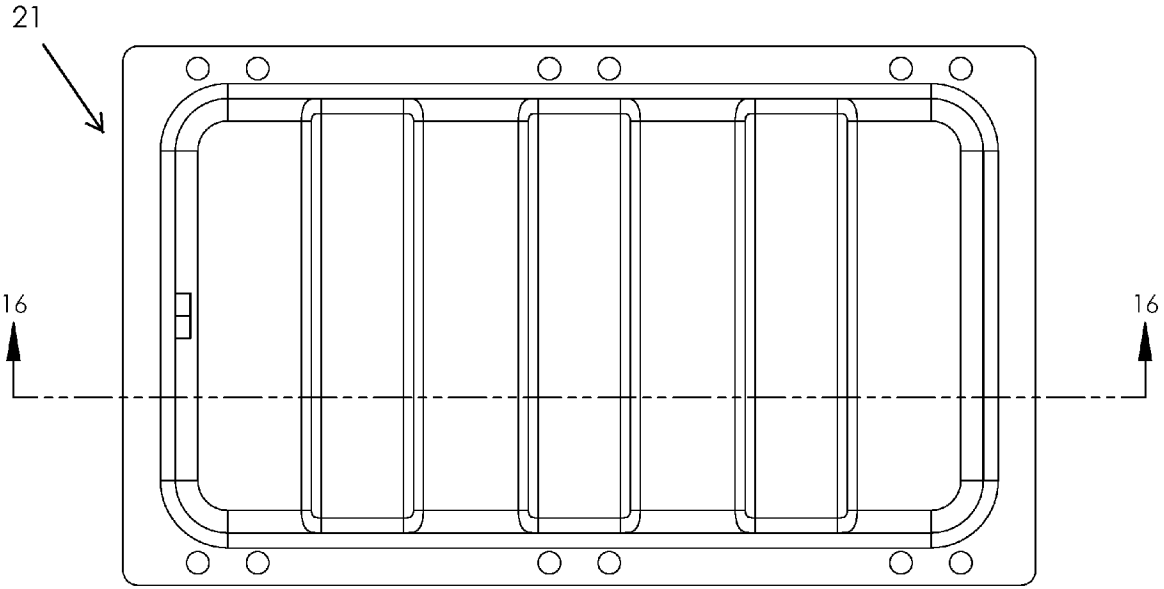
FIG. 15 is a top plan view of the in-wall or in-ceiling speaker back box illustrated in FIG. 14.
Figure 16:
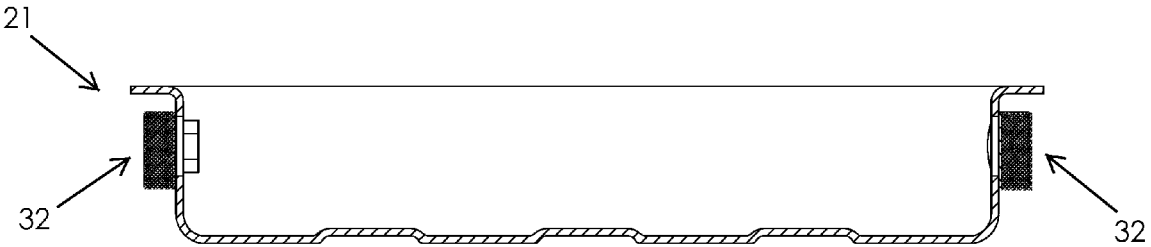
FIG. 16 is cross-sectional view taken along line 16-16 in FIG. 15.

Referring to FIGS. 14-16, speaker back box 21, the air-filtering member 32 may be positioned against an exterior side of the speaker back box 21.

Figure 17:
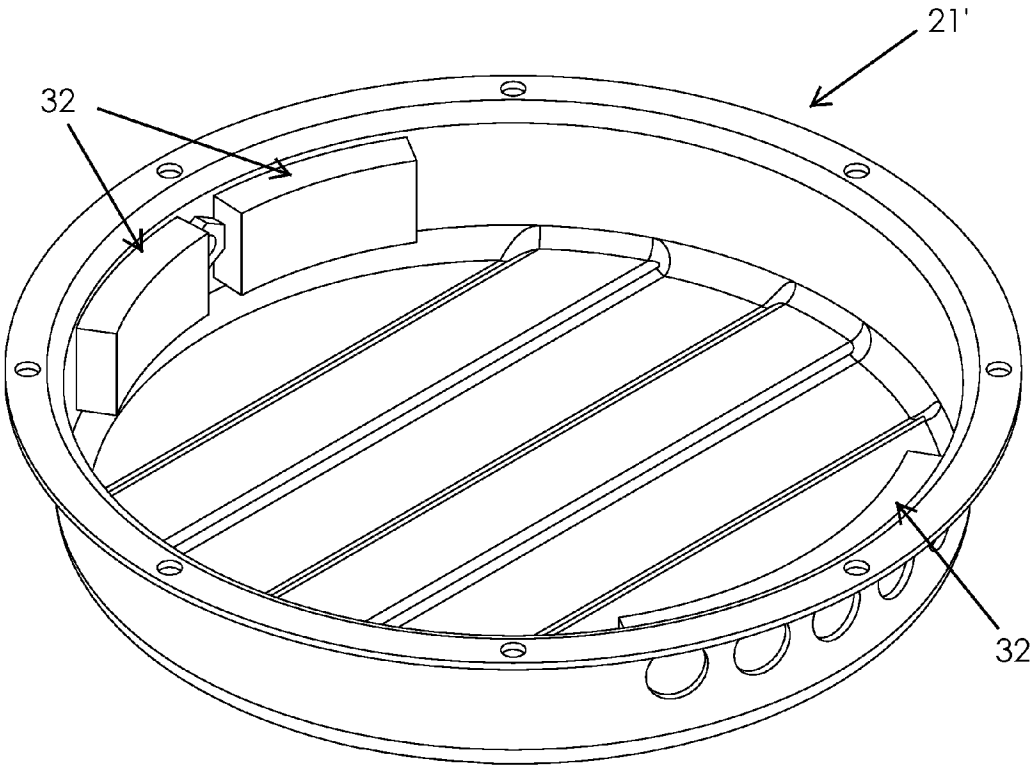
FIG. 17 is a perspective view of the in-wall or in-ceiling speaker back box wherein the air-filtering members are located exterior of thereof, in accordance with yet another embodiment.
Figure 18:
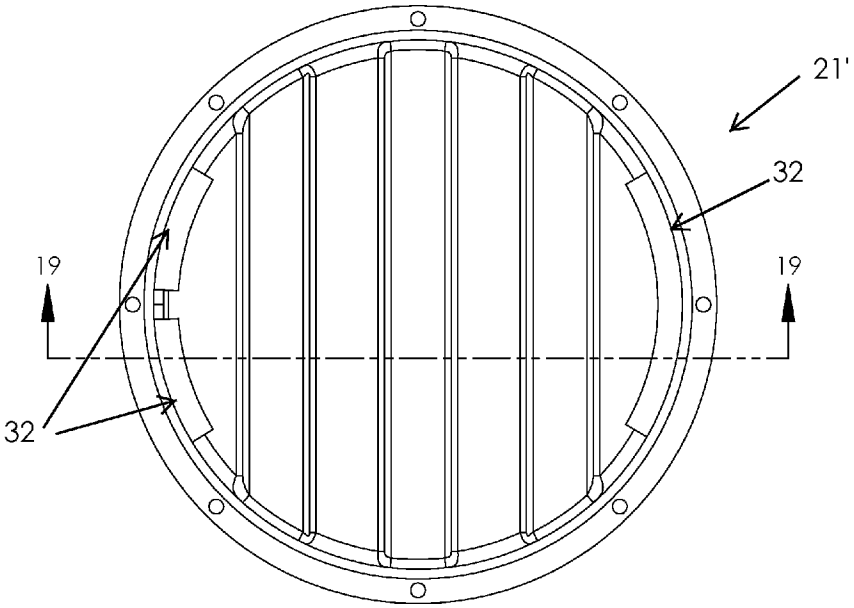
FIG. 18 is a top plan view of the in-wall or in-ceiling speaker back box illustrated in FIG. 17.
Figure 19:
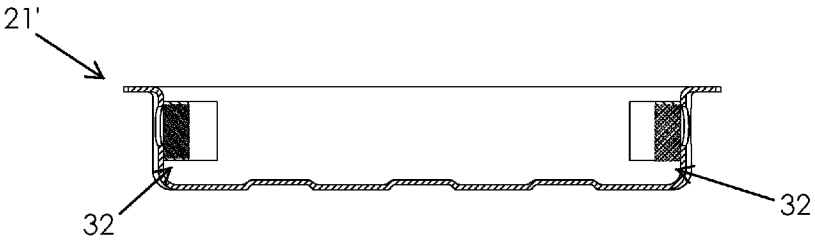
FIG. 19 is cross-sectional view taken along line 19-19 in FIG. 18.

Referring to FIGS. 17-19, in a non-limiting exemplary embodiment, the air-filtering member 32 may be positioned against an exterior side of the speaker back box 21', which may have an annular shape as sometimes used for in-ceiling environments.

The present disclosure further includes a method of utilizing an in-wall or in-ceiling speaker enclosure 20 for reducing undesirable sound transmission to an adjacent room while decreasing resonance and increasing bass output into a desired room. Such a method includes the initial step of: providing a speaker back box 21 having a single and unitary body 22 suitably sized and capable of being mounted inside one of a vertical wall cavity and a ceiling wall cavity. The speaker back box 21 includes a posterior surface 23, a plurality of sidewalls 24-27 engaged with the posterior surface 23 and extending anterior thereof wherein one of the sidewalls 24 includes a first aperture 30, and an anterior opening 29 is oppositely disposed from the posterior surface 23.

The method further includes the steps of: providing a flexible and resilient air-filtering member 32; and positioning the flexible and resilient air-filtering member 32 against the first aperture 30 such that the air-filtering member 32 is intermediately located between the posterior surface 23 and anterior opening 29. Such method steps provide the unexpected and unpredictable STC advantages of a solid-wall speaker back box while significantly lowering the resonance of the speaker system, thereby allowing it to produce much greater bass energy into the room.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. An in-wall or in-ceiling speaker enclosure for reducing undesirable sound transmission to an adjacent room while decreasing resonance and increasing bass output into a desired room, said in-wall or in-ceiling speaker enclosure comprising:

a speaker back box suitably sized and capable of being mounted inside one of a vertical wall cavity and a ceiling wall cavity, said speaker back box including a posterior surface, a plurality of sidewalls engaged with said posterior surface and extending anterior thereof, wherein one of said sidewalls includes a first aperture, and an anterior opening oppositely disposed from said posterior surface; and an air-filtering acoustically absorptive member positioned against said first aperture, wherein said air-filtering member is intermediately located between said posterior surface and anterior opening.

2. The in-wall or in-ceiling speaker enclosure of claim 1, wherein said sidewalls comprises:

a first sidewall, a second sidewall, a third sidewall and a fourth sidewall configured with said posterior surface to form a generally rectangular shape;

wherein said first sidewall is registered substantially parallel to said second sidewall;

wherein said third sidewall and said fourth sidewall are registered substantially orthogonal to each of said first sidewall and said second sidewall.

3. The in-wall or in-ceiling speaker enclosure of claim 2, wherein said first aperture is disposed at said first sidewall and spaced from said posterior surface.

4. The in-wall or in-ceiling speaker enclosure of claim 3, further comprising: a second aperture disposed at said second sidewall and spaced from said posterior surface.

5. The in-wall or in-ceiling speaker enclosure of claim 4, wherein said first aperture is oppositely disposed from said second aperture.

6. The in-wall or in-ceiling speaker enclosure of claim 2, wherein said air-filtering member comprises: a first acoustic insulation layer positioned anterior of said posterior surface and abutted against an interior face of said first sidewall such that an entire surface area of said first aperture is covered.

7. The in-wall or in-ceiling speaker enclosure of claim 6, wherein said air-filtering member further comprises: a second acoustic insulation layer positioned anterior of said posterior surface and abutted against an interior face of said second sidewall such that an entire surface area of said second aperture is covered.

8. The in-wall or in-ceiling speaker enclosure of claim 7, wherein said first acoustic insulation layer is oppositely disposed from said second acoustic insulation layer; wherein said first aperture is registered along a first plane registered substantially orthogonal to said posterior surface; wherein said second aperture is registered along a second plane registered substantially orthogonal to said posterior surface.

9. The in-wall or in-ceiling speaker enclosure of claim 7, wherein each of said first acoustic insulation layer and said second acoustic insulation layer comprises: an open cell foam containing an air-permeable cellular fiber material.

10. An in-wall or in-ceiling speaker enclosure for reducing undesirable sound transmission to an adjacent room while decreasing resonance and increasing bass output into a desired room, said in-wall or in-ceiling speaker enclosure comprising:

a speaker back box having a single and unitary body suitably sized and capable of being mounted inside one of a vertical wall cavity and a ceiling wall cavity, said speaker back box including a posterior surface, a plurality of sidewalls engaged with said posterior surface and extending anterior thereof, wherein one of said sidewalls includes a first aperture, and an anterior opening oppositely disposed from said posterior surface; and an air-filtering member positioned against said first aperture, wherein said air-filtering member is intermediately located between said posterior surface and anterior opening, wherein said air-filtering member is flexible and resilient.

11. The in-wall or in-ceiling speaker enclosure of claim 10, wherein said sidewalls comprises:

a first sidewall, a second sidewall, a third sidewall and a fourth sidewall configured with said posterior surface to form a generally rectangular shape;

wherein said first sidewall is registered substantially parallel to said second sidewall;

wherein said third sidewall and said fourth sidewall are registered substantially orthogonal to each of said first sidewall and said second sidewall.

12. The in-wall or in-ceiling speaker enclosure of claim 11, wherein said first aperture is disposed at said first wall and spaced from said posterior surface.

13. The in-wall or in-ceiling speaker enclosure of claim 12, further comprising: a second aperture disposed at said second sidewall and spaced from said posterior surface.

14. The in-wall or in-ceiling speaker enclosure of claim 13, wherein said first aperture is oppositely disposed from said second aperture.

15. The in-wall or in-ceiling speaker enclosure of claim 11, wherein said air-filtering member comprises: a first acoustic insulation layer positioned anterior of said posterior surface and abutted against an interior face of said first sidewall such that an entire surface area of said first aperture is covered.

16. The in-wall or in-ceiling speaker enclosure of claim 15, wherein said air-filtering member further comprises: a second acoustic insulation layer positioned anterior of said posterior surface and abutted against an interior face of said second sidewall such that an entire surface area of said second aperture is covered.

17. The in-wall or in-ceiling speaker enclosure of claim 16, wherein said first acoustic insulation layer is oppositely disposed from said second acoustic insulation layer; wherein said first aperture is registered along a first plane registered substantially orthogonal to said posterior surface; wherein said second aperture is registered along a second plane registered substantially orthogonal to said posterior surface.

18. The in-wall or in-ceiling speaker enclosure of claim 16, wherein each of said first acoustic insulation layer and said second acoustic insulation layer comprises: an open cell foam containing an air-permeable cellular fiber material.

19. A method of utilizing an in-wall or in-ceiling speaker enclosure for reducing undesirable sound transmission to an adjacent room while decreasing resonance and increasing bass output into a desired room, said method comprising the steps of:

providing a speaker back box having a single and unitary body suitably sized and capable of being mounted inside one of a vertical wall cavity and a ceiling wall cavity, said speaker back box including a posterior surface, a plurality of sidewalls engaged with said posterior surface and extending anterior thereof wherein one of said sidewalls includes a first aperture, and an anterior opening oppositely disposed from said posterior surface;

providing a flexible and resilient air-filtering member; and positioning said flexible and resilient air-filtering member against said first aperture such that said air-filtering member is intermediately located between said posterior surface and anterior opening.

* * * * *